US010340049B2

(12) United States Patent
Washington, II et al.

(10) Patent No.: US 10,340,049 B2
(45) Date of Patent: Jul. 2, 2019

(54) ALPHA/BETA RADIATION SHIELDING MATERIALS

(71) Applicant: Savannah River Nuclear Solutions, LLC, Aiken, SC (US)

(72) Inventors: Aaron L. Washington, II, Aiken, SC (US); James C. Nicholson, Aiken, SC (US)

(73) Assignee: Savannah River Nuclear Solutions, LLC, Aiken, SC (US)

( * ) Notice: Subject to any disclaimer, the term of this patent is extended or adjusted under 35 U.S.C. 154(b) by 83 days.

(21) Appl. No.: 15/228,448

(22) Filed: Aug. 4, 2016

(65) Prior Publication Data

US 2018/0040387 A1 Feb. 8, 2018

(51) Int. Cl.

| | |
|---|---|
| ***G21F 1/08*** | (2006.01) |
| ***G21F 3/02*** | (2006.01) |
| ***G21F 5/015*** | (2006.01) |
| ***G21F 1/10*** | (2006.01) |

(52) U.S. Cl.

CPC ..... *G21F 1/08* (2013.01); *G21F 1/103* (2013.01); *G21F 1/106* (2013.01); *G21F 3/02* (2013.01); *G21F 5/015* (2013.01)

(58) Field of Classification Search

CPC ..... G21F 1/00; G21F 1/02; G21F 1/08; G21F 1/10; G21F 3/00; G21F 3/02

See application file for complete search history.

(56) References Cited

U.S. PATENT DOCUMENTS

| | | | | |
|---|---|---|---|---|
| 4,001,587 | A * | 1/1977 | Panchenkov | G01T 1/04 250/474.1 |
| 4,447,734 | A * | 5/1984 | Kusumegi | G21F 7/03 250/515.1 |
| 5,062,186 | A | 11/1991 | Rampolla et al. | |
| 5,076,971 | A | 12/1991 | Barker | |
| 5,640,705 | A * | 6/1997 | Koruga | B82Y 30/00 252/625 |
| 5,814,824 | A | 9/1998 | Hamby et al. | |
| 6,355,078 | B1 | 3/2002 | Wickland | |
| 6,371,064 | B2 | 4/2002 | Yao et al. | |
| 7,631,758 | B2 | 12/2009 | Stennes et al. | |
| 2002/0060300 | A1 | 5/2002 | O'kane, Sr. et al. | |
| 2004/0200997 | A1 | 10/2004 | Soundararajan | |
| 2004/0211917 | A1 | 10/2004 | Adamovics | |
| 2005/0203229 | A1 | 9/2005 | Soundararajan | |
| 2005/0208290 | A1* | 9/2005 | Patel | C09K 11/06 428/323 |
| 2005/0211930 | A1* | 9/2005 | DeMeo | G01V 5/0008 250/516.1 |
| 2006/0054488 | A1 | 3/2006 | Harmon et al. | |
| 2006/0145091 | A1* | 7/2006 | Patel | G01T 1/04 250/474.1 |
| 2007/0075277 | A1* | 4/2007 | Smith | G21F 1/125 250/515.1 |
| 2007/0148457 | A1* | 6/2007 | Wagner | B29C 70/58 428/402 |
| 2007/0237829 | A1 | 10/2007 | Dadachova et al. | |
| 2007/0281244 | A9 | 12/2007 | Kasperchik et al. | |
| 2008/0128659 | A1 | 6/2008 | Parker et al. | |
| 2009/0114857 | A1 | 5/2009 | DeMeo et al. | |
| 2009/0117021 | A1* | 5/2009 | Smith | B82Y 30/00 423/290 |
| 2010/0124663 | A1* | 5/2010 | Furusawa | B32B 27/36 428/447 |
| 2011/0300360 | A1 | 12/2011 | Basfar et al. | |
| 2012/0217161 | A1* | 8/2012 | Chan | C12Q 1/6809 204/451 |
| 2012/0248346 | A1* | 10/2012 | Chowdhary | G21F 1/00 250/516.1 |
| 2012/0273622 | A1 | 11/2012 | Long | |
| 2013/0095307 | A1 | 4/2013 | Bennington et al. | |
| 2013/0119316 | A1* | 5/2013 | Sauti | G21F 1/00 252/478 |
| 2013/0270442 | A1 | 10/2013 | Penumadu et al. | |
| 2016/0180979 | A1* | 6/2016 | Washington, II | G21F 1/10 53/473 |
| 2016/0322122 | A1* | 11/2016 | Hayakawa | G21F 1/08 |
| 2017/0072604 | A1* | 3/2017 | Sjong | B29C 44/12 |

(Continued)

FOREIGN PATENT DOCUMENTS

| | | | |
|---|---|---|---|
| DE | 102005057428 | B3 | 8/2007 |
| WO | WO2004/081101 | A2 | 9/2004 |

(Continued)

OTHER PUBLICATIONS https://web.archive.org/web/20160925081438/https://en.oxforddictionaries.com/definition/bag (Year: 2016).*

Savannah River Nuclear Solutions, LLC; International Patent Application No. PCT/US2015/66250; International Search Report dated Mar. 11, 2016; 2 pages.

Harrison, etal.; "Polyethlene/Boron Nitride Composites for Space Radiation Shielding," *J. of Applied Polymer Science*, (2008) 109, pp. 2529-2538.

Lehnherr, "Conjugated Oligomers and Polymers Based on Anthracene, Teracene, Pentacene, naphthodithiophene, and Anthradithiophene Building Blocks," *Australian Journal of Chemistry* (2011) 64 (7), pp. 919-929.

Shepherd, et al.; "Optical, photoluminescent, and photoconductive properties of functionalized anthradithiophene and benzothiophene derivaties;" Chapter 1 in "*Advances in Lasers and Electro Optics*" edited by N. Costa and A. Cartaxo, Intech, (Apr. 2010) pp. 1-32.

(Continued)

*Primary Examiner* — Wyatt A Stoffa

(74) *Attorney, Agent, or Firm* — Dority & Manning, PA

(57) ABSTRACT

Alpha/beta radiation barrier materials and structures formed to include the barrier materials are described. Barrier materials include a matrix and particulate materials contained in the matrix. The particulates include alpha/beta radiation absorbers. Alpha/beta radiation absorbers of the barrier materials can be molecular, particulates, or defined nanostructures that are capable of absorbing incident alpha/beta particle energies. Matrix materials can include organic or inorganic materials including thermoplastic polymers, thermoset polymers, glasses, ceramics, etc.

14 Claims, No Drawings

(56) References Cited

U.S. PATENT DOCUMENTS

2017/0200518 A1* 7/2017 Yang ..... B32B 27/00

FOREIGN PATENT DOCUMENTS

WO WO2005/060671 A2 7/2005
WO WO2016/100596 6/2016

OTHER PUBLICATIONS

Stowe, et al; "Catalytic Carbon Nanostructures and Novel Nanocomposites for Hydrogen Storage," *Journal of the South Carolina Academy of Science*: (2011) vol. 9: Iss. 1, Article 7, pp.
Washington, II, et al., U.S. Appl. No. 14/573,499, filed Dec. 17, 2014, Reinforced Radiological Containment Bag.

* cited by examiner

ALPHA/BETA RADIATION SHIELDING MATERIALS

STATEMENT AS TO RIGHTS TO INVENTIONS MADE UNDER FEDERALLY SPONSORED RESEARCH

This invention was made with Government support under Contract No. DE-AC09-08SR22470 awarded by the United States Department of Energy. The Government has certain rights in the invention.

BACKGROUND

Alpha and beta radiation producing isotopes are utilized or produced in many fields and, while not as high in ionizing and penetrating power as other forms of radiation, still present health dangers and must be handled and disposed of accordingly. For instance, radionuclides common in transuranic waste (TRU) can produce high levels of both alpha and beta radiation. TRU is generally defined as waste that has been contaminated with transuranic radionuclides (i.e., possessing atomic numbers greater than that of uranium) in concentrations greater than 100 nCi/g (3.7 MBq/kg). In the U.S. TRU is generally a byproduct of weapons production, nuclear research and power production, and includes protective gear, tools, residue, debris and other items contaminated with small amounts of radioactive elements. TRU contains such radionuclides as Californium (Cf-249, Cf-252), Americium (Am-241, Am-242, and Am-243), Curium (Cm-242, Cm-250), *Neptunium* (Np-235, Np-236), Plutonium (Pu-236, Pu-238, Pu-239, Pu-242) and Berkelium (Bk-247, Bk-250), as well as their respective decay products.

Under U.S. law, TRU is categorized into "contact-handled" (CH) and "remote-handled" (RH) on the basis of the radiation field measured on the waste container's surface. CH-TRU has a surface dose rate not greater than 2 mSv per hour (200 mrem/h), whereas RH-TRU has rates of 2 mSv/h or higher. CH-TRU has neither the high radioactivity of high level waste nor its high heat generation as CH-TRU waste emits mostly alpha radiation and relatively small levels of beta radiation, but it is still potentially harmful, particularly due to inhalation hazards.

Of course, TRU is not the only material that produces alpha and/or beta radiation and requires controlled handling and storage. Other alpha emitting sources include radium, thorium, actinium, and uranium to name a few. Additionally, strontium (e.g., SR-90), which undergoes beta decay, is commonly used as a radioactive source in cancer therapy and as a radioactive tracer in both medical and agricultural applications. Tritium, primarily produced in nuclear power generation systems, also undergoes beta decay, and the radium isotope Ra-223 that has been approved by the FDA in cancer treatment emits primarily alpha and beta particles.

These and other alpha and beta particle emitting materials present serious issues with regard to proper handling and disposal. For instance, the use of medicinal grade radioactive solutions (e.g., Sr-90) is undergoing great expansion. Military use of radioactive materials creates additional levels of radioactive waste that must be safely handled, stored, transported, and disposed of. Safety issues also exist in decommissioned uranium/plutonium enrichment plants, which have left behind contaminated soils, equipment, and wastes that have to be properly disposed of. Moreover, utilities continue to create significant amounts of nuclear waste from power generation plants.

While alpha/beta radiation does not require a heavy lead shielding, it still presents challenges for safe storage and containment. Exposure to alpha and beta radiation can induce chronic, carcinogenic and mutagenic health effects that lead to cancer, birth defects, and death. One of the main hazards of alpha radiation is its potential for exposure by inhalation or ingestion. Inhalation of such materials even in very small quantities can deliver a significant internal radiation dose. Tons of solid, liquid, and sludge radioactive wastes have been generated and they will continue to be generated in the future by commercial and private industries as well as government agencies. These materials must be safely and cost effectively shielded, managed, and disposed of, to prevent health and economic consequences to the global environment.

Current shielding used for radiation/nuclear applications and general radiation and nuclear protection includes solid constructed structures that are large and extremely heavy. These conventional shielding structures are difficult to transport and are typically permanent structures that require substantial installation time and costs.

More flexible and transportable containment systems have been developed, but these systems generally require multiple individual layers of different materials to increase mechanical and containment properties and storage/transport systems generally involve placing the waste material into two or more polymeric containers (e.g., bags) and then storing the multi-layer containers in metal containers as the polymeric materials exhibit less than ideal resistance to radiological degradation and mechanical forces. For instance, currently utilized polymeric containment systems tend to show little resistance to radiolysis leading to the decomposition of the polymers and hydrogen production, which can cause both flammability and over pressurization hazards. Moreover, due to short life span of the containers, re-packaging of the waste is often required, which increases the occupational dose to the workers as well as risk to both the workers and the environment, particularly as re-packaging is often carried out only after degradation has been detected and the containment field of the bag has been compromised.

What are needed in the art are containment materials that exhibit increased resistance to radiological degradation events, and in particular alpha and beta particle emission. Containment materials that can signal effects of degradation prior to compromise of the containment field of the container would also be of great benefit.

SUMMARY

Aspects and advantages of the invention will be set forth in part in the following description, or may be obvious from the description, or may be learned through practice of the invention.

In one embodiment disclosed is a radiological barrier material that includes a matrix and a particulate contained within the matrix. More specifically, the particulate can have a cross section of about 500 micrometers or less and can include an alpha/beta radiation absorber. For instance, the particulate can be formed of the alpha/beta radiation absorber or can include the radiation absorber on the surface or within the particle. In particular embodiments, the alpha/beta radiation absorber can be a metal oxide particulate or a defined nanostructure (e.g., a nanotube, nanosphere, nanoribbon, etc.) that in one embodiment can be formed of carbon or an aluminosilicate (e.g., halloysite) or such structures decorated with other materials (e.g. metal particles, metal oxide particles, monomers, organics, etc.). The matrix that contains the alpha/beta absorber can be an organic matrix (e.g., formed from a thermoplastic or thermoset polymeric composition) or an inorganic matrix (e.g., a glass, ceramic, or silicone-based matrix).

In one embodiment, the radiological barrier material can include a degradation detection chromophore that can exhibit photonic emission characteristics and/or provide a color that can vary in a detectable fashion upon direct or indirect interaction with alpha/beta radiation. Accordingly, the degradation detection chromophore can provide early detection of degradation of the containment material and thus potential breach of the containment field provided by the material can be avoided.

Radiological barrier materials as disclosed herein can be utilized in storage and/or transport of alpha/beta emitting materials as well as in protective applications, e.g., in forming personal protective equipment.

Also disclosed is a method for forming the barrier material. The method can include forming a composite by combining a matrix material with the particulate alpha/beta radiation absorber and then depositing the composite to form the barrier material. The method can include additional steps depending upon the nature of the matrix material. For instance, a formation method can include molding a polymeric-based composite via, e.g., extrusion, melt-forming, solution-forming, and the like; crosslinking a polymer of a polymeric-based composite; molding and firing a ceramic-based composite, etc.

These and other features, aspects and advantages of the present disclosure will become better understood with reference to the following description and appended claims.

DETAILED DESCRIPTION

It is to be understood by one of ordinary skill in the art that the present discussion is a description of exemplary embodiments only, and is not intended as limiting the broader aspects of the present disclosure. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The present disclosure is generally directed to radiation barrier materials and structures formed to include the barrier materials that can provide long-lasting protection from alpha/beta radiation emitters. As utilized herein, the term "alpha/beta" is intended to refer to materials that emit either one or both of alpha and beta radiation. The barrier materials can withstand incident alpha/beta radiation at various energies that may be emitted from alpha/beta producing isotopes including, without limitation, Cf-249, Cf-252, Am-241, Am-242, Am-243, Cm-242, Cm-250, Np-235, Np-236, Pu-236, Pu-238, Pu-239, Pu-242, Bk-247, Bk-250, Ra-223, H-3, and Sr-90.

Beneficially, the barrier materials include one or more alpha/beta radiation absorbers incorporated within the matrix of the material. As such, the barrier materials can be provided in one embodiment as a single layer barrier material that can exhibit both mechanical strength and radiation barrier strength. In fact, in some embodiments, the alpha/beta radiation absorbers that are incorporated in the barrier material can increase the mechanical strength of the materials as compared to a similar material that is formed without the addition of the alpha/beta radiation absorbers.

The barrier materials can exhibit additional desirable qualities through selection of the particular matrix material. For instance, the barrier materials can exhibit a transparency level according to established parameters in place for existing barrier platforms while providing long-term alpha/beta radiation protection and mechanical strength. Through incorporation of the alpha/beta radiation absorbers within the matrix of a barrier material, the highly stable absorbers can provide mechanical enhancement to the matrix as well as non-hydrogen forming degenerate materials, thereby limiting hazards associated with radiation due to radiolysis.

Alpha/beta radiation absorbers can be formed as or carried by particulate materials. Without wishing to be bound to any particular theory, it is believed that the alpha/beta radiation absorbers can absorb incident radiation via kinetic slowing of the particles combined with Coulombic interactions. Thus, the alpha/beta radiation absorbers can absorb the incident radiation via non-nuclear reactions and/or interactions rather than imparting the incident alpha/beta energy to the surrounding matrix. The particulate additives can also mitigate radiation damage through shielding as the particulates can be incorporated into the matrix at a relatively high density in some embodiments. The absorption and shielding capabilities can provide resistance and stability to the barrier material and can extend the life of the structures formed of the barrier material allowing for longer term handling, storage and/or transport.

Particles that can be incorporated in a matrix as alpha/beta radiation absorbers can be micro- or nanoscale particles. For instance, individual microscale particles can generally have a cross sectional dimension of about 500 micrometers or less, about 300 micrometers or less, about 100 micrometers or less, about 50 micrometers or less, or about 10 micrometers or less, in some embodiments. Nanoscale particles can generally have a cross sectional dimension of about 1000 nanometers or less, about 500 nanometers or less, about 300 nanometers or less, about 100 nanometers or less, about 50 nanometers or less, or about 10 nanometers or less in some embodiments. In one embodiment, the alpha/beta radiation absorbers can include both micro- and nano-scale materials. For instance, micro-scale particles can be surface decorated with nano-scale particles, which can be formed of the same or different materials.

In one embodiment, an alpha/beta radiation absorber can be a semiconductive material and can have a relatively high electron density for effective absorption of alpha/beta energy. For instance, an alpha/beta radiation absorber can have an electron density of about $5\times10^{23}$ electrons per cubic centimeter or greater, about $8\times10^{23}$ electrons per cubic centimeter or greater or about $1\times10^{24}$ electrons per cubic centimeter or greater. In one embodiment, the alpha/beta radiation absorber can have an electron density of from about $3\times10^{23}$ to about $1.5\times10^{24}$ electrons per cubic centimeter.

Electron density can be estimated according to standard modeling processes. For example, computer simulation or materials modeling may include a computational method based on Monte Carlo N-Particle Extended (MCNP-X) program. MCNP-X is a computational method that derives properties of the molecule or collection of molecules based on a determination of the electron density of the molecule. Unlike the wavefunction, which is not a physical reality but a mathematical construct, electron density is a physical characteristic of all molecules. A functional is defined as a function of a function, and the energy of the molecule is a functional of the electron density. The electron density is a function with three variables: x-, y-, and z-position of the electrons. Unlike the wavefunction, which becomes significantly more complicated as the number of electrons increases, the determination of the electron density is independent of the number of electrons.

In one embodiment, the alpha/beta radiation absorber can include a metal oxide. By way of example, a particulate alpha/beta radiation absorber can include $TiO_2$, $FeO_2$, $AlO_2$, $CeO_2$, $WO_4$, $Cr_2O_3$, $SiO_2$, $MgO_2$, $CaO_2$, $BaO_2$, CoO, $VO_2$, $NiO_2$, $CuO_2$, ZnO, $YO_2$, $Na_2WO_2$, or $ZrO_2$ as well as combinations of one or more metal oxides.

Metal oxide particles can be obtained or formed according to any suitable method. By way of example, and without limitation, metal oxide particles have been prepared by reacting metal-containing precursors under various conditions. For instance, metal oxide nanoparticles have been produced using thermolysis of organometallic precursors such as described, for example, in Nakamoto et al., Kagaku to Kogyo, 78, 503 (2004); sol-gel processes as described, for example, in Briois et al., Chem. Mater., 16, 3885 (2004); oxidation of metal salts as described, for example, in Jiang et al., J. Phys. Chem. B, 109, 8774 (2005); and hydrothermal processes as described, for example, in Shen et al., Mater. Lett., 58, 3761 (2004). Metal oxide particles have also been prepared by solution phase methods in which a metal salt is reacted with hydroxide ions as described, for example, by Spanhel and Anderson, J. Am. Chem. Soc., 113, 2826 (1991).

U.S. Pat. No. 6,432,526 to Arney, et al. (incorporated herein by reference) describes a method of forming dispersible crystalline metal oxide nanoparticles that includes reacting metal alkoxides with a sub-stoichiometric amount of a complexing agent including a carboxylic acid having a carbon chain of about 3 carbon atoms to about 18 carbon atoms. The process also includes the steps of partially hydrolyzing this product by the addition of sub-stoichiometric amounts of water and finally thermally treating the partially hydrolyzed mixture by heating under pressure at a temperature in the range of about 150° C. to about 265° C. for an amount of time sufficient to form the crystalline particles.

U.S. Pat. No. 5,994,252 to Feige, et al. (incorporated herein by reference) describes a method of forming metal oxide particles that includes reducing and evaporating materials used to produce evaporated metal oxide products, oxidizing the evaporated products and condensing as melt particles and cooling the melt particles further to form metal-oxide powder particles.

Metal oxide particles can be combined with a dispersing aid that can optionally attach to the surface of the metal oxide particles. The inclusion of dispersing aids may allow higher concentrations of the particles to be incorporated into a matrix and avoid agglomeration of the particles during formation of the composite. Suitable dispersing aids include, without limitation, alkoxyorganosilanes, organic acids such as carboxylic acids, alcohols, polyethylene glycols, mono- or di-asters of fatty acids, polyethylene oxide and polypropylene oxide, stearic acid, oleic acid, or combinations thereof. Exemplary alkoxyorganosilanes include octyltriethoxysilane, octadecyltrimethoxysilane, hexadecyltrimethoxysilane, and combinations thereof. Dispersing aids that are coupling agents (i.e., a dispersing aid with two functional groups) may be used. Exemplary coupling agents include methacrylic acid, glycine, glycolic acid, thiolacetic acid, methacryloyloxyethyl acetoacetate, allyl acetoacetate, 3-acryloxypropyltrimethoxysilane, 3-aminopropyltriethoxysilane, 3-mercaptopropyltrimethoxysilane, 3-glycidoxypropyltrimethoxysilane, 7-oct-1-enyltrimethoxysilane, and allyl triethoxysilane. After the addition of a dispersing aid, a slurry can typically have a ratio of dispersing agent to metal oxide particles of about 0.1 to 6.0 millimole/gram. A slurry can be stirred, generally with heating, until the particles disperse to provide a stable colloid for combination with the matrix material of choice.

In one embodiment, the alpha/beta radiation absorber can be in the form of a defined nanostructure. As utilized herein, the term "defined nanostructure" generally refers to highly ordered molecular structures that include one or more layers in a consistent shape. Defined nanostructures as may be incorporated in a barrier material can include carbon-based nanostructures based upon graphene including fullerenes (e.g., carbon nanotubes, carbon nanospheres, carbon nanoonions), carbon nanoribbons, etc. Fullerenes can encompass carbon fused ring systems in any size and shape including spheres, ellipsoids, and nanotubes. For instance, a $C_{60}$ fullerene can be an effective alpha/beta radiation absorber.

Methods for producing carbon-based nanostructures can include chemical vapor deposition (CVD) methods in which a raw material gas, such as a hydrocarbon, is decomposed, and catalyst chemical vapor deposition (CCVD) methods. Methods that have been developed to form isolated single walled nanotubes (SWNT) can involve the formation and utilization of a particularly patterned substrate (see, for example, 'Synthesis of individual single-walled carbon nanotubes on patterned silicon wafers'. Kong, et al., Nature, 395, pp. 878-881 (Oct. 29, 1998)). Methods for forming nanostructures having a particular shape, for instance nanostructures that are coiled along their axial length have been described by Nakayama, et al. (U.S. Pat. No. 6,558,645, incorporated herein by reference), disclose a formation method for producing nanocoils.

Methods of forming fullerenes in relatively large amounts have been disclosed in U.S. Pat. No. 5,227,038 (incorporated herein by reference) in which carbon is vaporized in an electrical arc and the carbon vapor condenses into fullerenes. Other fullerene formation methods include vaporizing carbon from a rotating solid disk of graphite into a high-density helium flow using a focused pulsed laser and also a method in which a carbon rod is evaporated by resistive heating under a partial helium atmosphere. The resistive heating of the carbon rod is said to cause the rod to emit a faint gray-white plume. Soot-like material comprising fullerenes is said to collect on glass shields that surround the carbon rod.

Defined nanostructure alpha/beta radiation absorbers are not limited to carbon-based materials. For instance aluminosilicate nanotubes, and in one particular embodiment halloysite (i.e., $Al_2Si_2O_5(OH)_4$) nanotubes can be utilized. Halloysite is a nano-sized plate type aluminum silicate mineral and has a layer structure in which different layers are alternately layered in a ratio of 1:1. The outer surface of the halloysite comprises a silicate $SiO_2^-$ layer, and the inner surface comprises an alumina $Al_2O_3^+$ layer. Halloysite naturally has a hollow nanotubular structure, in which the inner diameter is about 30 to 250 nm and the length is about 0.2 to 0.4 μm.

Semiconductor materials in the form of particulates are another example of alpha/beta radiation absorbers. For example, semi-conductors commonly known as quantum dots, which are semiconductor nanocrystals having size-dependent optical and electronic properties. In particular, the band gap energy of a quantum dot can vary with the diameter of the crystal. Many semiconductors that are constructed of elements from groups II-VI, III-V and IV of the periodic table can be prepared as quantum sized particles, exhibit quantum confinement effects in their physical properties, and can function as alpha/beta radiation absorbers as described herein. Exemplary materials suitable can include, without limitation, ZnS, ZnSe, ZnTe, CdS, CdSe, CdTe, GaN, GaP, GaAs, GaSb, InP, InAs, InSb, AlS, AlP, AlAs, AlSb, PbS, PbSe, Ge, and Si and ternary and quaternary mixtures thereof. The quantum dots may further include an overcoating layer of a semiconductor having a greater band gap.

Energy absorbing chromophores can be utilized as alpha/beta radiation absorbers in some embodiments. By way of example, chromophores as may be utilized as alpha/beta radiation absorbing materials can include, without limitation, those having the following structures:

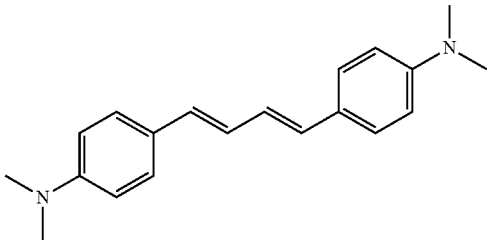

$C_{20}H_{24}N_2$

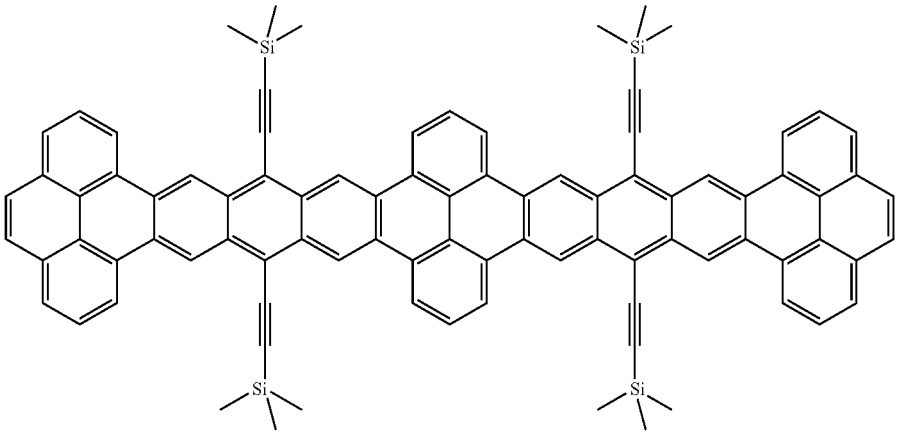

$C_{88}H_{66}Si_4$

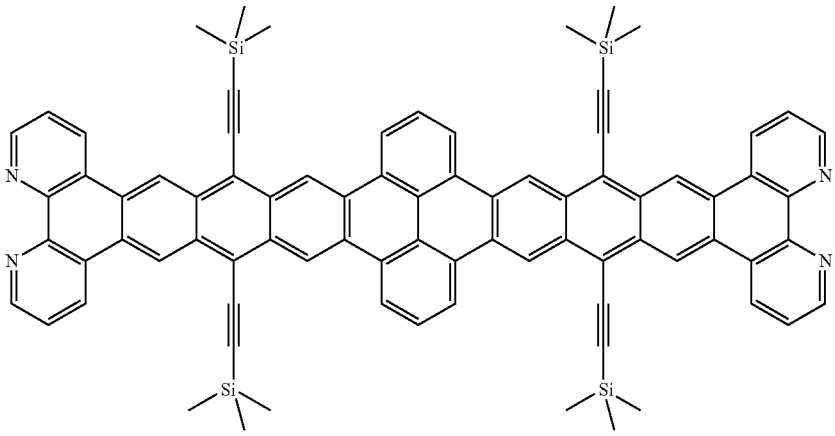

$C_{90}H_{62}N_4Si_4$

-continued
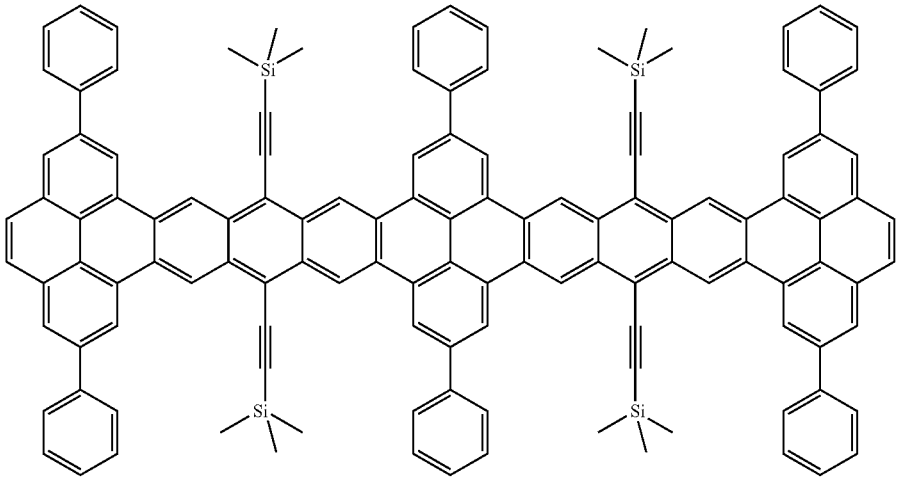
$C_{124}H_{90}Si_4$
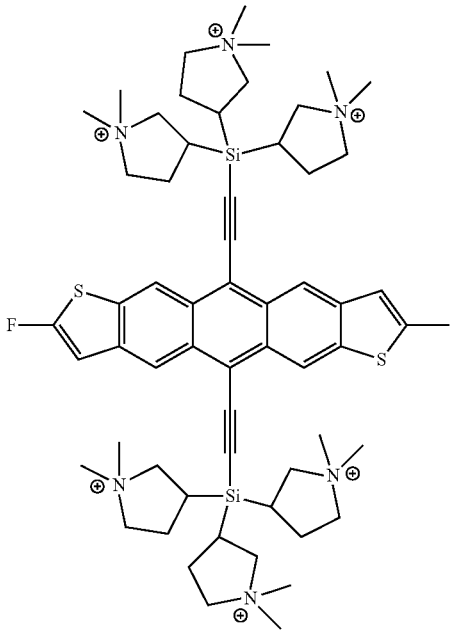
$C_{46}H_{44}N_6Si_2F_2$
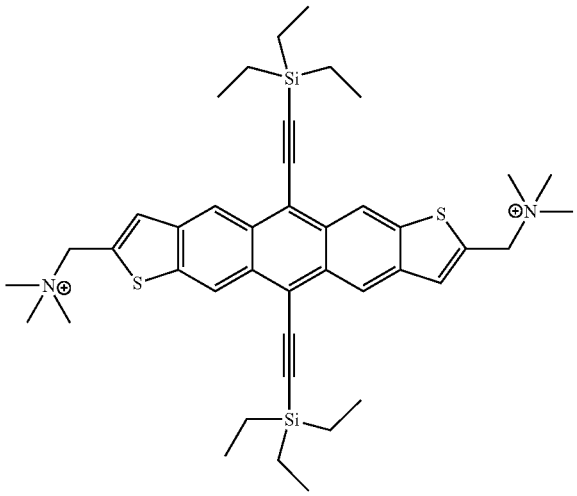
$C_{36}H_{46}Si_2N_2Si_2$
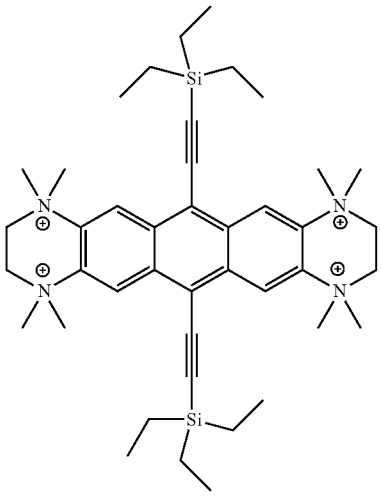
$C_{34}H_{50}N_4Si_2$ Molecular alpha/beta radiation absorbers such as the energy absorbing chromophores can be decorated onto the surface of particles or nanostructures that can also function as alpha/beta radiation absorbers (e.g., metal oxide particles) or can be carried by an inert particle. For example, molecular materials can be decorated on the surface of carbon nanotubes, halloysite nanotubes, quantum dots, fullerenes (e.g., $C_{60}$, graphene particles, etc.).

Alpha/beta radiation absorber particulates can be surface decorated with other alpha/beta radiation absorbers or other beneficial materials. For example, in one embodiment defined nanostructure alpha/beta radiation absorbers can be derivatized, for instance to improve incorporation into the matrix. By way of example, a carbon-based nanostructure can be modified with an oligomer as described in U.S. Pat. No. 8,674,134 to Zettl, et al. (incorporated herein by reference) so as to more uniformly disperse the alpha/beta radiation absorber throughout the matrix.

Other derivatizations of alpha/beta radiation absorbers can include formation of composites with metal hydrides such as $NaAlH_4$, $LiAlH_4$, and $LiBH_4$ as described by Stowe, et al. (Journal of the South Carolina Academy of Science, 2011, 9(1) 13-19). Derivations of halloysite alpha/beta radiation absorbers can be achieved through the deposition or growth of particulate (e. g. metal or metal oxide nanoparticles, etc.) onto the surface or functionalization through the successive deposition of polymer layers through either direct coating or through such processes as layer-by-layer growth.

The amount of the alpha/beta radiation absorber component (which can include one or a combination of different alpha/beta radiation absorber materials) included in a barrier material can generally depend upon the nature of the matrix material and of the barrier material. For instance, when considering an inorganic matrix, the alpha/beta radiation absorber component can form up to about 70 wt. % of the barrier material, for instance from about 10 wt. % to about 70 wt. % of the barrier material, in some embodiments. Similarly, when considering an opaque barrier material, the barrier material can include a relatively high proportion of the alpha/beta radiation absorber, whether the matrix is organic or inorganic in nature. For example, an opaque barrier material can include the alpha/beta radiation absorber component in an amount of about 80 wt. % or less, or about 50 wt. % or less in some embodiments, for instance from about 5 wt. % to about 80 wt. % in some embodiments. A transparent barrier material can include a high proportion of alpha/beta radiation absorber component in those embodiments in which the absorber component is also transparent, but in other embodiments, the barrier material can include a smaller amount of the absorber component in forming a transparent barrier material. For example, in some embodiment, the barrier material can include the alpha/beta radiation absorber component in an amount of about 5 wt. % or less of the barrier material, for instance about 4 wt. % or less, about 3.5 wt. % or less, or about 1 wt. % or less in some embodiments.

As previously stated, the matrix of the barrier material can be an organic or inorganic matrix. In one embodiment, the alpha/beta radiation absorbing particulates can be uniformly dispersed throughout the matrix. This is not a requirement however, and in some embodiments the alpha/beta radiation absorbers can be heterogeneously dispersed throughout the matrix.

An organic matrix can include thermoset polymers, thermoplastic polymers, or a combination thereof in either a blend or in a bonded copolymer formation.

In one embodiment, the matrix can include one or more thermoplastic polymers such as, without limitation, polyurethane, polyolefins (e.g., polyethylene, polypropylene), polyvinylchloride, polyvinylpyrrolidone, polyamides, polyvinyl alcohols, natural latex, ethylene vinyl acetates, polyesters, polyisoprenes, polystyrenes, polysulfones, acrylonitrile-butadiene-styrene, polyacrylates, polycarbonates, polyoxymethylenes, polytetrafluoroethylenes, ionomers, celluloses, polyetherketones, polysiloxanes, polyarylsulfides, liquid crystal polymers, elastomers, copolymers of any of the above, derivatives of any the above, polymer blends, etc.

An organic matrix can optionally be formed from a thermoset resin matrix based upon one or more thermoset network-forming polymers. When the resin is cured, the resin undergoes an increase in viscosity and the polymer chains cross link and set, such that the resin can no longer flow. This change is not reversible. After curing, the thermoset resin has a characteristic glass transition temperature. If the material is heated to above this temperature, the component will soften, but it will not melt on further heating, it will instead deteriorate if the applied temperatures are too high.

A thermoset composition can include one or more thermoset polymers as are generally known in the art. For example a thermoset composition can include a matrix resin selected from one or more of an epoxide, a polyimide, a bis-maleimide, a polyphenol, a polyester, etc., or combinations thereof that, when fully cured, forms a crosslinked thermoset matrix.

An epoxy as may be utilized as the matrix resin in a thermoset composition may suitably comprise epoxy compounds having more than one epoxide group per molecule available for reaction. Such epoxy prepolymers include, but are not limited to, polyfunctional ethers of polyvalent phenols, for example pyrocatechol; resorcinol; hydroquinone; 4,4'-dihydroxydiphenyl methane; 4,4'-dihydroxy-3,3'-dimethyldiphenyl methane; 4,4'-dihydroxydiphenyl dimethyl methane; 4,4'-dihydroxydiphenyl methyl methane; 4,4'-dihydroxydiphenyl cyclohexane; 4,4'-dihydroxy3,3'-dimethyldiphenyl propane; 4,4'-dihydroxydiphenyl sulphone; or tris-(4-hydroxyphenyl) methane; polyglycidyl ethers of the chlorination and bromination products of the above-mentioned diphenols; polyglycidyl ethers of novolacs (i.e., reaction products of monohydric or polyhydric phenols with aldehydes, formaldehyde in particular, in the presence of acid catalysts); polyglycidyl ethers of diphenols obtained by esterifying 2 moles of the sodium salt of an aromatic hydroxycarboxylic acid with 1 mol of a dihalogenoalkane or dihalogen dialkyl ether; and polyglycidyl ethers of polyphenols obtained by condensing phenols and long-chain halogen paraffins containing at least 2 halogen atoms.

Other suitable thermoset materials include polyepoxy compounds based on aromatic amines and epichlorohydrin, for example N,N'-diglycidylaniline; N,N'-dimethyl-N,N'-diglycidyl-4,4'-diaminodiphenyl methane; N-diglycidyl-4-aminophenyl glycidyl ether; N,N,N',N'-tetraglycidyl-4,4'-diaminodiphenyl methane; and N,N,N',N'-tetraglycidyl-1,3-propylene bis-4-aminobenzoate.

Glycidyl esters and/or epoxycyclohexyl esters or aromatic, aliphatic and cycloaliphatic polycarboxylic acids, for example phthalic acid diglycidyl ester and adipic ester diglycidyl and glycidyl esters are also suitable. Glycidyl ethers of polyhydric alcohols, for example of 1,4-butanediol; 1,4-butenediol; glycerol; 1,1,1-trimethylol propane; pentaerythritol and polyethylene glycols may also be used.

A thermoset composition can include curing/crosslinking agents as are generally known in the art. Such curing agents are well known to those skilled in the art, and include, without limitation polyfunctional carboxylic acids, diols, diamines, and the like. Specific examples of polyfunctional carboxylic acid crosslinking agents can include, without limitation, isophthalic acid, terephthalic acid, phthalic acid, adipic acid, azelaic acid, dicarboxyl dodecanoic acid, succinic acid, maleic acid, glutaric acid, suberic acid, azelaic acid and sebacic acid. Exemplary diols useful as crosslinking agents can include, without limitation, aliphatic diols, aromatic diols, cycloaliphatic diols, and the like. Exemplary diamines that may be utilized as crosslinking agents can include, without limitation, aliphatic diamines, (cyclo)aliphatic diamines, and aromatic diamines.

Conventional additives may be combined with the polymer(s) in forming an organic matrix to improve the flexibility, strength, durability or other properties of the barrier material and/or to help insure that the barrier material has an appropriate uniformity and consistency. Conventional additives as may be incorporated in a polymeric composition can include, without limitation, impact modifiers, fillers, antimicrobials, lubricants, dyes, pigments or other colorants, antioxidants, stabilizers, surfactants, flow promoters, solid solvents, plasticizers (e.g., epoxy soybean oil, ethylene glycol, propylene glycol, etc.), curing catalysts, nucleators, electrically conductive additives, emulsifiers, surfactants, suspension agents, leveling agents, drying promoters, adhesives, flow enhancers, flame retardants, etc. and other materials added to enhance properties and processability. In one embodiment, the polymeric composition can include a yellow colorant, which can be utilized to designate possible radiological contamination. Such additives may be employed in a polymeric composition in conventional amounts.

Additives in a thermoset composition can include thermoplastic materials such as found in toughened epoxies that can incorporated thermoplastic impact modifiers incorporated in the thermoset matrix as well as other additives as are generally known in the art.

An organic barrier material can generally be formed through combination of the polymeric composition with the alpha/beta radiation absorber according to standard practice for addition of an additive to a polymeric composition. For instance, a thermoplastic composition including a thermoplastic polymer, the alpha/beta radiation absorber, and any additional additives as desired can be compounded according to standard melt or solution processing techniques. The additives of a composition including the alpha/beta radiation absorber can be combined with the other components of a composition in any sequence and combination, with preferred additions generally depending upon the specific polymers of the composition.

Following formation, a polymeric composition including the alpha/beta radiation absorber can be processed to form the barrier material having the desired form. By way of example, a barrier material can be an extruded or solution cast film formed of a thermoplastic or thermoset composition and formed to have a thickness as is generally known in the art. For instance, a polymeric sheet can be formed to a thickness of about 5 mils or greater, about 8 mils or greater, about 12 mils or greater, or about 20 mils or greater in some embodiments. For instance, a polymeric sheet can have a thickness of from about 5 mils to about 30 mils, in some embodiments.

Of course, an organic barrier material can have any desired form including fibers, sheets, or any other form. In one embodiment, a barrier material can be in the form of a textile (e.g., a woven, non-woven, or knitted textile) that can include individual fibers formed of the barrier material.

When considering an organic barrier material that includes a thermoset-based matrix, the thermoset polymer(s) of the matrix can generally be finally cured following formation, according to standard practice. For instance, following extrusion, pultrusion, etc. of the polymeric composition to the final desired form, the thermoset polymer of the composition can be finally cured by use of added energy in the form of heat, UV light, IR energy, etc.

In some embodiments, the matrix that incorporates the alpha/beta radiation absorber can be an inorganic matrix. For example, the matrix can be a glass matrix or a ceramic matrix.

In general, any of a variety of glass materials can be utilized in forming a barrier material. For example, the barrier material can include a matrix formed of an oxide glass, such as a silicate glass, a phosphate glass, a germanate glass, and the like. As another example, the barrier material can include a halide glass matrix, such as a fluoride glass. As yet another example, the barrier material can include a matrix based upon a chalcogenide, such as a sulfide glass, a selenide glass, a telluride glasses, and the like. By way of example, silica glass, borosilicate glass, and so forth can be utilized in forming the barrier material.

A glass-based barrier material can be formed into any desired shape, e.g., a fiber, container, sheet, or the like. For example, the desired glass matrix material in the form of a powder, chips, etc. can be combined with the alpha/beta radiation absorber in the desired amount, and a mixture of the two can be melt processed according to standard practice to provide the barrier material. For instance, a melt including the glass matrix material and the alpha/beta radiation absorber can be drawn to form glass fibers that include the absorber held in the glass matrix of the fiber.

In one embodiment, glass fibers incorporating the alpha/beta radiation absorber can be formed and the glass fibers can be further processed to form a barrier material. For instance, glass fibers incorporating the alpha/beta radiation absorber can be held in a polymeric matrix, e.g., an epoxy, polyester, or vinyl ester thermoset or thermoplastic matrix to form a fiberglass barrier material. The glass fibers can be arranged in any pattern according to standard practice.

A ceramic matrix material can be an oxide ceramic, or a non-oxide ceramic, as desired. Non-limiting examples of suitable oxide ceramic materials can include alumina, alumina-silica, and alumina-boria-silica. Non-limiting examples of suitable non-oxide ceramics can include silicon carbide, silicon nitride, silicon carbide containing titanium, silicon oxycarbide, and silicon oxycarbonitride.

In general, a ceramic preform including the ceramic of choice and the alpha/beta radiation absorber may be formed using conventional processes and equipment. For instance, a pre-ceramic matrix slurry may be formulated to include formation materials to form a oxide ceramic matrix material or a non-oxide ceramic matrix material upon further processing (e.g., sintering, pyrolysis, etc.) in conjunction with the alpha/beta radiation absorber.

As a non-limiting example, a pre-ceramic matrix slurry may be an oxide-based pre-ceramic matrix slurry including an oxide ceramic sol and an oxide ceramic filler in conjunction with an alpha/beta radiation absorber. The oxide ceramic sol may be an alumina sol (e.g., colloidal alumina in water), a silica sol (e.g., colloidal silica in water), an alumina-silica sol (e.g., colloidal alumina-silica in water), or a combination thereof. In some embodiments, the oxide ceramic sol is a silica sol. Solids may generally constitute from about 15 wt. % to about 60 wt. % of the total weight of the oxide ceramic sol. An oxide ceramic filler may include particles of at least one oxide ceramic material, such as particles of at least one of alumina, silica, zirconia. In some embodiments, the oxide ceramic filler includes particles of alumina. Each of the particles may be of a desired size (e.g., within a range of from about 20 nanometers to about 1000 nanometers) and shape (e.g., a spherical shape, a hexahedral shape, an ellipsoidal shape, a cylindrical shape, an irregular shape, etc.). In addition, the particles may be monodisperse, wherein each of the particles has substantially the same size and shape, or may be polydisperse, wherein the particles include a variety of sizes and/or shapes.

The ratio of the oxide ceramic sol to the oxide ceramic filler in the oxide-based pre-ceramic matrix slurry may depend on the properties (e.g., thermal stability, viscosity, weight, conductivity, etc.) of the materials selected for the oxide ceramic sol and the oxide ceramic filler, on the processing conditions used to form the barrier material, and on the desired properties (e.g., thermal stability, thermal-shock resistance, mechanical stability, hardness, corrosion resistance, weight, conductivity, etc.) of the barrier material to be formed. The solids of an oxide-based pre-ceramic matrix slurry may, for example, include from about 20 wt. % to about 60 wt. % of the oxide ceramic sol, from about 20 wt. % to about 80 wt % of the oxide ceramic filler, and up to about 60 wt. % of the alpha/beta radiation absorber, for instance from about 0.1 wt. % to about 50 wt. % of the alpha/beta radiation absorber in some embodiments.

Optionally, an oxide-based pre-ceramic matrix may also include at least one processing aid as is known in the art. A processing aid may, for example, comprise a material that enhances at least one of the rigidity, tackiness, and environmental resistance properties (e.g., maximum possible exposure time to processing conditions) of the pre-ceramic matrix and/or the barrier material. For example, a processing aid may comprise a water-soluble organic material including, but not limited to, a polyol (e.g., glycerol), a cellulose gum (e.g., methyl cellulose), a vinyl alcohol (e.g., polyvinyl alcohol), a glycol propylene glycol, ethylene glycol), and acacia gum.

In one embodiment, a pre-ceramic matrix slurry may be a non-oxide-based pre-ceramic matrix slurry including a non-oxide pre-ceramic polymer, a non-oxide ceramic filler, and an alpha/beta radiation absorber. A non-oxide pre-ceramic polymer may be an organosilicon polymer formulated to form a non-oxide ceramic matrix upon further processing (e.g., curing and pyrolysis). For example, a non-oxide pre-ceramic polymer may comprise at least one of a polysiloxane, a polysilazane (e.g., at least one of a hydridopolysilazane, a silacyclobutasilazane, a boron modified hydridopolysilazane, and a vinyl-modified hydridopolysilazane), a polysilane, a polycarbosilane, a polycarbosilazane, and a polysilsesequioxane. A non-oxide ceramic filler may include particles of at least one non-oxide ceramic material, such as particles of at least one of silicon carbide, silicon nitride, silicon hexaboride, aluminum nitride, boron nitride, boron carbide, titanium boride, titanium carbide, and hafnium carbide. Each of the particles may be of a desired size and shape as discussed above.

The ratio of a non-oxide pre-ceramic polymer to non-oxide ceramic filler in a non-oxide-based pre-ceramic matrix slurry may be related to the properties (e.g., thermal stability, viscosity, weight, conductivity, etc.) of the materials, on the processing conditions, and on the desired properties of the barrier material to be formed. The solids of a non-oxide-based pre-ceramic matrix slurry may, for example, include from about 20 wt. % to about 60 wt. % of the oxide ceramic sol, from about 20 wt. % to about 80 wt. % of the oxide ceramic filler, and from about 0.1 wt. % to about 60 wt. % of the alpha/beta radiation absorber.

Optionally, a non-oxide pre-ceramic matrix may also include one or more of at least one curing catalyst, and at least one compatible solvent (e.g., tetrahydrofuran, hexane, heptane, benzene, toluene, xylene, etc.). If included, a curing catalyst may constitute from about 0.1 percent to about 2 wt. % of the total weight of the pre-ceramic matrix.

A pre-ceramic matrix slurry may be formed using conventional processes and equipment. Regardless of the process utilized to form the pre-ceramic composite material, the process may be controlled to facilitate formation of a uniform pre-ceramic matrix green structure.

Following formation, the partially uncured green structure may be subjected to a curing process and a densification process to form a barrier material exhibiting a desired configuration. The curing process may include subjecting the green structure to energy, e.g., elevated temperature(s), elevated pressure(s), UV cure, microwave, etc. (e.g., using a curing apparatus, such as an autoclave, a compression mold, or a lamination press) for a sufficient period of time to form a substantially cured structure having sufficient mechanical integrity to be handled. As a non-limiting example, a curing process may include exposing a green structure to at least one temperature less than or equal to about 175° C. and at least one pressure less than or equal to about 100 pounds per square inch (psi) for a sufficient period of time to form the substantially cured structure.

A densification process may include sintering or pyrolyzing the substantially cured structure at elevated temperature(s) (e.g., using a densification apparatus, such as a high-temperature furnace) to form a barrier structure. For example, if the substantially cured structure includes an oxide pre-ceramic matrix, the substantially cured structure may be sintered at a temperature within a range of from about 1000° C. to about 1350° C. for a sufficient amount of time to form an oxide ceramic structure. As another example, if the substantially cured structure includes a non-oxide pre-ceramic matrix, the substantially cured structure may be pyrolyzed at a temperature within a range of from about 600° C. to about 1400° C. in an inert ambient atmosphere (e.g., a nitrogen atmosphere, an argon atmosphere, etc.) to convert at least 70 percent of the pre-ceramic polymer of the non-oxide pre-ceramic matrix to a non-oxide ceramic material and form a non-oxide ceramic structure. If the pyrolysis process converts less than all of the pre-ceramic polymer to the non-oxide ceramic material, the non-oxide ceramic structure may be infiltrated with additional pre-ceramic polymer using conventional processes, and may then be subjected to at least one additional pyrolysis process until the non-oxide ceramic structure exhibits a non-oxide ceramic matrix formed of and including a desired amount of the non-oxide ceramic material.

Independent of the matrix material, in one embodiment, a barrier material can include a degradation detection material such as a chromophore that can exhibit a change in photonic emission characteristics and/or a change in color as one or more components (e.g., the chromophore itself) of the layer are degraded due to interaction with alpha/beta radiation. As utilized herein, the term "photonic emission characteristics" generally refers to the photonic emission of a material following excitation of the material. The term "color" generally refers to a natural characteristic of the material and is not dependent upon excitation of the material. Upon degradation of one or more components of the barrier material, a chromophore can exhibit a change in photonic emission characteristics (the emission characteristics following subjection to a defined excitation energy) and can also exhibit a change in the natural color of the chromophore (i.e., the natural color with no excitation energy necessary). Alternatively, a chromophore can exhibit only one of these responses, i.e., either a change in photonic emission characteristics or a change in color.

Addition of a degradation detection chromophore to a barrier material can provide for early detection of degradation of the material. For example, a degradation detection chromophore can be incorporated internally in a defined nanostructure alpha/beta radiation absorber, such as $C_{60}$ and, upon degradation of the alpha/beta radiation absorber, the chromophore can provide a visual cue as the potential degradation of the barrier material.

Examples of suitable degradation detection chromophores as may be incorporated in the materials include vinyl compounds containing substituted and unsubstituted phenyl, substituted and unsubstituted anthracyl, substituted and unsubstituted phenanthryl, substituted and unsubstituted naphthyl, substituted and unsubstituted heterocyclic rings containing heteroatoms such as oxygen, nitrogen, sulfur, or combinations thereof, such as pyrrolidinyl, pyranyl, piperidinyl, acridinyl, quinolinyl. Other chromophores are described in U.S. Pat. No. 6,114,085, and in U.S. Pat. Nos. 5,652,297, 5,763,135, 5,981,145, 6,187,506, 5,939,236, and 5,935,760, which may also be used, and are incorporated herein by reference.

As a barrier material begins to degrade, this can alter the emission spectra and/or the color of the degradation detection chromophore, either through a loss in emission, a change in emission wavelength, or a change in the absorption/reflection characteristics (i.e., the color), depending upon the specific chromophore incorporated, and this alteration can be detected. Suitable detectors can depend upon the nature of the particular chromophore utilized (e.g., the emission wavelength), as is known. For example, in one embodiment, the degradation detection chromophore can emit at a detectable wavelength upon excitation via the alpha particle radiation, and alternation in this emission can be monitored. Alternatively, the barrier material can be monitored by use of an external excitation source (e.g. UV light), and alteration in emission in response to this external source can be monitored.

In one particular embodiment, the degradation detection chromophore can provide a visually detectable signal, and an excitation and/or detection device such as a spectrometer may not be needed. For instance, the degradation detection chromophore can appear to have a certain color or can be clear upon formation of the barrier material, and upon decomposition or radiolysis the chromophore will be chemically altered (e.g., loss of a constituent group) and the visual appearance of the chromophore will change. The alteration in the chromophore upon degradation or radiolysis can be any alteration that leads to a detectable change including, without limitation, loss of a constituent group, crystal structure alteration, oxidation, reduction, etc.

A barrier material can be utilized to form a containment or protection device, with preferred devices generally depending upon the specific nature of the barrier material. For example, a flexible barrier material (e.g., an organic polymeric-based barrier material or a fibrous organic or inorganic based barrier material) can be utilized in forming containment bags, personal protective equipment (e.g., gloves, face shields, body suits, etc.), and so forth. A non-flexible barrier material, e.g., a ceramic or glass panel, an organic thermoset polymer based structure, and the like can be utilized to form a non-flexible containment structure, shielding structure, and the like.

The highly stable and efficient alpha/beta shielding provided by the disclosed barrier material can be utilized in packaging, storage, and handling of radiological material and can provide high stability against radiolysis and polymer degradation combined with effective shielding. Disclosed barrier materials can be utilized a wide variety of applications including containment, personal protective equipment, radiological sensing, long-term material storage, high quality radiological transport, and colorimetric dosimetry, just to name a few.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A radiological barrier material comprising a matrix and a particulate having a cross sectional dimension of about 500 micrometers or less contained within the matrix, the particulate comprising a radiation absorber that absorbs either one or both of alpha and beta radiation, the particulate comprising a defined nanostructure, the defined nanostructure comprising an aluminosilicate nanotube, the radiation absorber comprising a metal oxide, the radiation absorber further comprising an energy absorbing chromophore on the surface of the particulate.

2. The radiological barrier material of claim 1, wherein the radiation absorber further comprises a semiconductor.

3. The radiological barrier material of claim 1, wherein the matrix comprises an organic matrix.

4. The radiological barrier material of claim 1, wherein the matrix comprises an inorganic matrix.

5. The radiological barrier material of claim 4, wherein the inorganic matrix comprises a glass or a ceramic.

6. The radiological barrier material of claim 1, wherein the radiological barrier material is in the form of a fiber or a sheet.

7. A container for radiation emitting material, the container comprising the radiological barrier material of claim 1.

8. The container of claim 7, wherein the container comprises a flexible bag.

9. The container of claim 8, wherein the container is a single-layer flexible bag.

10. Personal protective equipment comprising the radiological barrier material of claim 1.

11. The personal protective equipment of claim 10, wherein the personal protective equipment comprises a glove.

12. The personal protective equipment of claim 10, wherein the personal protective equipment comprises a face shield or a body suit.

13. The radiological barrier material of claim 1, wherein the metal oxide comprises $TiO_2$, $FeO_2$, $AlO_2$, $CeO_2$, $WO_4$, $Cr_2O_3$, $SiO_2$, $MgO_2$, $CaO_2$, $BaO_2$, CoO, $VO_2$, $NiO_2$, $CuO_2$, ZnO, $YO_2$, $Na_2WO_2$, $ZrO_2$ or a combination of one or more metal oxides.

14. The radiological barrier material of claim 1, wherein the particulate is formed of the metal oxide.

* * * * *